United States Patent [19]

Wurmli

[11] 3,973,647

[45] Aug. 10, 1976

[54] OIL SUPPLY APPARATUS FOR RING SPINNING MACHINES AND RING TWISTING MACHINES

[75] Inventor: Arthur Wurmli, Winterthur, Switzerland

[73] Assignee: Rieter Machine Works, Ltd., Winterthur, Switzerland

[22] Filed: Oct. 7, 1974

[21] Appl. No.: 512,951

[30] Foreign Application Priority Data

Oct. 19, 1973 Switzerland ..... 14791/73

[52] U.S. Cl. ..... 184/7 A; 57/120; 57/137

[51] Int. Cl.[2] ..... D01H 7/62

[58] Field of Search ..... 57/120, 136, 137; 184/7 A

[56] References Cited

UNITED STATES PATENTS

| | | | |
|---|---|---|---|
| 2,479,401 | 8/1949 | Pope | 57/120 |
| 2,815,639 | 12/1957 | Ridgway | 57/120 |
| 3,018,605 | 1/1962 | Sherrill et al. | 57/120 |
| 3,302,382 | 2/1967 | Kluttz | 57/120 |

*Primary Examiner*—Richard C. Queisser
*Assistant Examiner*—Charles Gorenstein
*Attorney, Agent, or Firm*—Kenyon & Kenyon Reilly Carr & Chapin

[57] ABSTRACT

Each oil branch duct is mounted on the machine frame so that, as the ring rail moves downwardly into an underwinding position relative to the bobbins, the oil branch duct is inserted into the oil duct carried on the ring rail. A metered flow of oil is injected into the oil duct during this time. When the ring rail moves upwardly, the oil duct moves away from the branch oil duct to interrupt the oil supply connection.

11 Claims, 2 Drawing Figures

OIL SUPPLY APPARATUS FOR RING SPINNING MACHINES AND RING TWISTING MACHINES

Figure 1:
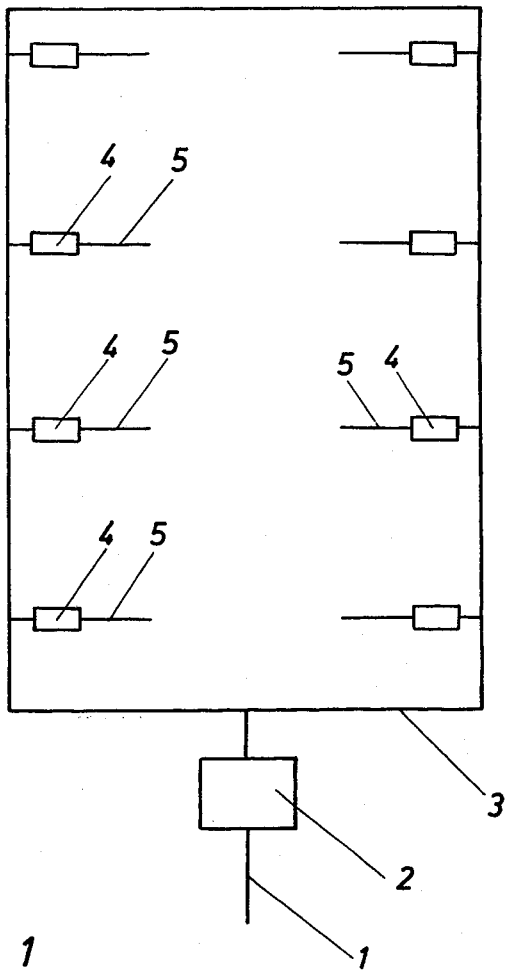

This invention relates to an oil supply apparatus for ring spinning machines and ring twisting machines and particularly those machines with travellers or ring travellers which require lubrication via the surface of the spinning rings.

It has been known to equip ring spinning machines and ring twisting machines with various oil supply devices in order to lubricate the ring travellers used on such machines. For example, manual filling of an oil duct in each ring rail as needed has been known. In such a case, a wick inserted in each spinning or twisting ring, in a known manner, draws in oil from the oil duct and gives the oil off via openings in the ring to the ring surface where the oil serves as a lubricant between ring and traveller. This arrangement, however, has a disadvantage in that too much oil is supplied by the wick to the ring surface, wherefrom the oil is thrown off by the traveller. This causes contamination of the machine parts and of the yarn or thread being processed. If this disadvantage is to be avoided, finer wicks would have to be used. However, the function of such finer wicks would be unsatisfactory due to their fineness. Thus, felt is generally placed in the oil duct and only as much oil as would just saturate the felt is filled in. Each wick then gives off a satisfactory quantity of oil to each ring surface over a certain period of time. In most cases, oil is resupplied only once or twice per week. As a result, the ring surfaces frequently are provided with an insufficient quantity of oil or with no oil at all, or if oil is eventually resupplied in excess, the wicks also give off excessive oil quantities. A manual oil supply is thus in no way satisfactory quite apart from the considerable manual work and from the danger of oil spills outside the duct which in themselves already present a considerable disadvantage.

In order to avoid the disadvantages of the manual-type of oil supply, oil has been supplied into the oil duct by a pump via a flexible connecting hose. In this arrangement, the pump can be operated manually or automatically at certain time intervals. This arrangement, however, has the disadvantage that the connecting hose moves with the ring rail and thus is worn out prematurely. Also, in order to clean the ring rail, the hose connection has to be dismantled and then re-established after cleaning.

Other oil supply devices have also been known, for example, as described in the German O.S. 2,125,714, which individually supplies oil to each ring. In addition, a metering device is provided upstream of each ring to permit the supply of an oil quantity to be limited in such a manner that the ring is lubricated over a short time interval. The time interval can be pre-set automatically in such a manner that the metering device always supplies the predetermined quantity of oil at the right moment. This arrangement, however, implies the use of very fine metering devices which frequently clog due to contaminations or air contents of the oil. This causes interruption of the ring lubrication. A further disadvantage resides in their high price.

Accordingly, it is an object of the present invention to avoid the disadvantages mentioned and to create an oil supply apparatus which ensures reliable lubrication of the rings in a simple manner.

It is another object of the invention to supply an accurate amount of oil to an oil supply for the ring travellers.

It is another object of the invention to replenish the oil of an oil duct on a ring rail at precise times of operation in an automatic fashion.

Briefly, the invention provides an oil supply apparatus for a ring spinning or twisting machine having a machine frame, at least one ring rail which is movably mounted relative to the machine frame and which guides the spinning rings with the travellers, and an oil duct in communication with a respective ring rail for supplying oil thereto. The oil supply apparatus supplies oil to the oil ducts and includes an oil pump, a common oil supply line extending from the pump, at least one oil branch duct extending from the supply line and a metering means in the oil branch duct for metering oil. Each oil branch duct is mounted on the machine frame below and adjacent a respective oil duct and has an outlet disposed for insertion into the oil duct upon downward movement of the oil duct over the oil branch duct in sealing relation during movement of the ring rail into a lowest position. That is, this relative movement occurs as the ring rail moves into an underwinding position relative to a bobbin. Removal of the oil branch duct from the oil duct occurs as the ring rail moves upwardly toward a highest position, that is, into a bobbin winding position.

Figure 2:
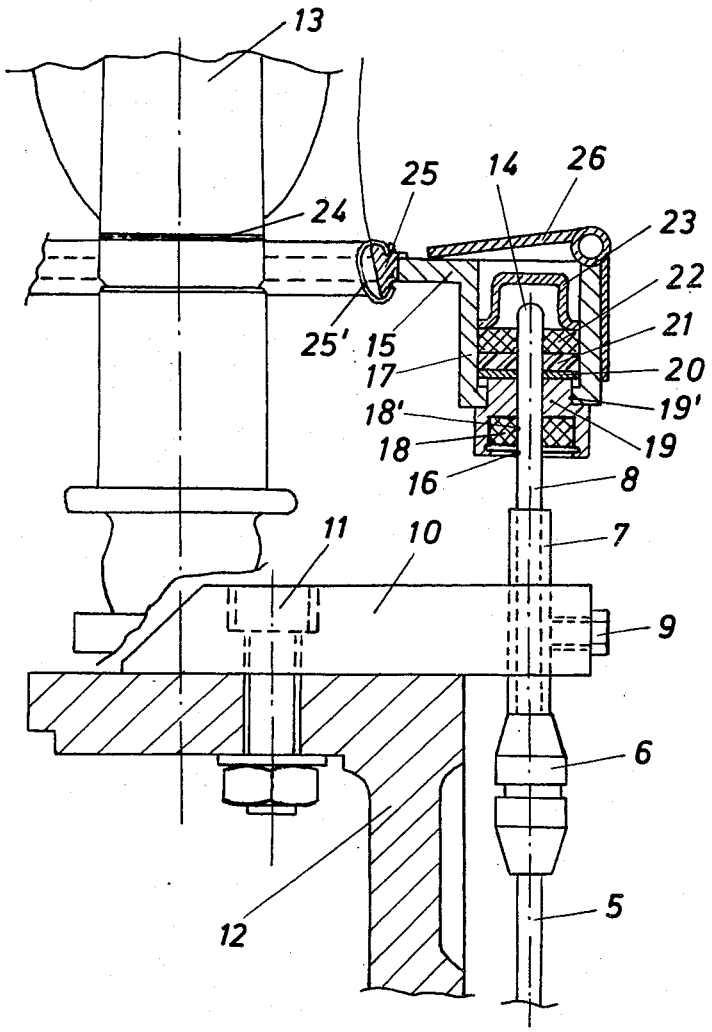

These and other objects and advantages of the invention will become more apparent from the following detailed description and appended claims taken in conjunction with the accompanying drawings in which:

FIG. 1 schematically illustrates a lay-out of an oil supply apparatus with oil branch ducts corresponding to the individual ring rails in accordance with the invention; and FIG. 2 illustrates a partial sectional view of an oil branch duct inserted in an oil duct in accordance with the invention.

Referring to FIG. 1, an oil supply apparatus for a number of ring spinning or twisting machines includes an oil pump 2 with an oil reservoir (not shown) which gives off oil into a common oil supply line 3 which is laid out as a closed loop. The pump 2 is activated by a compressed air line 1. The line 3 can, however, also be laid out as one line per machine side (not shown). In addition, oil branch ducts 5 extend from the supply line 3 to each machine into the vicinity of each ring rail. Each branch duct 5 includes a metering means 4. In this arrangement, the oil branch ducts 5 give off oil only if the compressed air line 1 activates the oil pump 2.

Referring to FIG. 2, each oil branch duct 5 is made e.g. of Nylon material and is mounted in a tube 7 by screw fittings 6. Each duct 5 communicates with an oil tube 8 of smaller diameter which protrudes from the tube 7 and which has an outlet at the top. The tube 7 is, in turn, mounted in a tube holder 10 arranged between two spindles 13 located at the middle of a machine side. On long machines, of course, a plurality of oil branch ducts 5 can be provided on each machine side arranged at equal mutual distances.

The tube holder 10 is rigidly mounted onto a spindle rail 12 by a screw 11 in a detachable manner. The height position of the tube 7, and thus of the upper end 14 of the oil tube 8, can be adjusted by a screw 9. The tube 7 is arranged precisely at the corresponding location in the tube holder 10, and its height position is adjusted, in such manner that while a ring rail 15 is lowered to its lowest position for underwinding, an opening 16 in an oil duct 17 of the ring rail 15 takes up the upper end 14 of the oil tube 8. While the ring rail 15 is in its lowest position, the upper end 14 of the oil tube 8 is thus inserted into the oil duct 17. As shown, the upper side of the oil duct 7 is covered by a spring cover 26.

The oil supply to the oil duct 17 is effected in the manner described in the following. During the spinning or twisting operation, the upper end 14 of the oil tube 8 is free in the room. That is, the upper end is spaced from the oil duct 17 in an exposed condition. As the ring rail 15 is lowered to the underwinding position, the opening 16 of the oil duct 17 moves toward the upper oil tube end 14. First, a felt tape 18 in the oil duct having a corresponding opening 18', is lowered into the upper oil tube end 14. This felt tape 18 is held in place by a felt holder 19 which is placed in an opening 19' in the bottom part of the duct 17. The felt tape 18 is provided for cleaning fibers or other contaminants from the upper oil tube end 14. Subsequently, the felt holder 19, a tape holder 20 and an oil-resistant rubber tape 21 and a felt tape 22, all of which are provided with a corresponding penetration opening, slide past the upper oil tube end 14. As the ring rail 15 reaches its lowest position, the upper oil tube end 14 is located approximately at mid-height within the oil duct 17. The final position of the upper oil tube end 14, however, can be adjusted further upward or downward by setting the screw 9. The felt tape 22 is held in place by a sheet metal member 23 which also acts as a fender for the oil released from the upper oil tube end 14. The tape holder 20 holds the rubber tape 21 in place in a manner not illustrated in the drawing. As the upper oil tube end 14 is inserted into, or removed from, the oil duct 17, displacement of the parts 20, 21 and 22 thus is prevented.

After a sufficient number of underwinding wraps are formed, the machine is stopped. In order to doff the full bobbins, the thread guides (not shown) are tiled up. The same compressed air line 1 is used to control the tilting motion of the thread guides and simultaneously activates the piston of the oil pump 2. The metering means 4 (FIG. 1) then gives off a determined quantity of oil to all oil branch ducts 5.

The oil quantity given off by the metering means 4 now flows through the oil branch duct 5 and is ejected from the upper oil tube end 14 against the fender 23. From there, the oil drips down onto the felt tape 22. The felt tape 22 effects even distribution of the oil over the whole duct length. Wicks (not illustrated) transport the oil from the felt tape 22 onto the ring surface of the individual rings 25 so as to lubricate the travellers or ring travellers 25'. After the oil quantity determined by the metering means 4 is ejected into the duct 17, the upper oil tube end 14 still remains in the position illustrated in FIG. 2.

Only after the full bobbins have been doffed does the pressure in the compressed air line 1 drop in such manner that the thread guides are lowered back to their operating position and the piston of the pump 2 is moved back to its idle position. As the machine is started up again new bobbin packages are being built, the ring rail 15 and the oil duct 17 are lifted. The various components 18–22 in the oil duct thus slide up over the upper oil tube end 14 while the rubber tape 21 clears any oil which remains there from the tube end 14. Instead of a rubber tape 21, a suitable seal could be used.

During bobbin packages build process, the oil tube 8 again is exposed in the room and only during the next following underwinding operation is surrounded again by the oil duct 17 into which oil is again ejected during the bobbin doffings process.

The invention thus provides an oil supply apparatus which functions in such manner that a constant quantity of oil is given off into an oil duct of a ring spinning or twisting machine each time full bobbin packages have been produced. The oil quantity to be supplied is adapted to the bobbin package filling time by pre-setting the oil metering device. If the bobbin package filling time is changed as another yarn count is processed, the oil quantity to be supplied can be adapted to this processing time by exchanging the metering means provided in the oil branch ducts, if the metering devices are not adjustable. The felt tapes in the oil ducts are always resupplied with constant quantities of oil after constant yarn processing time periods. The spinning rings are thus lubricated very evenly in simple manner by using the apparatus described. If desired, oil could be also re-supplied only after completion of two or more bobbin packages.

What is claimed is:

1. In combination with a ring spinning or twisting machine having a machine frame, at least one ring rail movably mounted relative to said machine frame for guiding of the running rings with the travellers thereon, and an oil duct in communication with a respective ring rail for supplying oil thereto;

an apparatus for supplying oil to said oil duct comprising an oil pump, a common oil supply line extending from said pump, at least one oil branch duct extending from said supply line and mounted on said machine frame below and adjacent each respective oil duct, said oil branch duct having an outlet for oil disposed for insertion into said oil duct upon downward movement of said oil duct over said oil branch duct in sealing relation thereto during movement of said ring rail into a lowest position and removal from said oil duct upon upward movement of said oil duct from said oil branch duct during movement of said ring rail toward a highest position, and a metering means in said oil branch duct for metering oil therethrough.

2. The combination as set forth in claim 1 wherein said opening is in the end of said oil branch duct.

3. The combination as set forth in claim 1 wherein said oil branch duct is adjustably mounted in said machine frame to vary the height of said oil branch duct relative to said oil duct.

4. The combination as set forth in claim 1 which further includes a spindle rail mounted on said machine frame and a tube holder detachably mounted on said rail, said tube holder having said oil branch duct mounted therein.

5. The combination as set forth in claim 1 which further includes a felt holder in said oil duct and a felt tape therein for receiving oil from said oil branch duct.

6. The combination as set forth in claim 5 which further includes a tape holder in said oil duct and an oil-resistant rubber tape in said tape holder for passage of said branch oil duct.

7. The combination as set forth in claim 5 which further includes a sheet metal member in said oil duct holding said felt tape in place and being disposed opposite the point of insertion of said oil branch duct into said oil duct to act as a fender for the supplied oil.

8. The combination as set forth in claim 1 wherein said lowest position of said ring rail is an underwinding position.

9. In combination with an oil duct on a movably mounted ring rail, an apparatus for supplying oil to said oil duct comprising an oil pump, an oil supply line extending from said pump, an oil branch duct extending from said supply line and mounted below and adjacent said oil duct, said oil branch duct having an outlet for oil disposed for insertion into said oil duct upon downward movement of said oil duct over said oil branch duct in sealing relation thereto during movement of said ring rail into a lowest position and removal from said oil duct upon upward movement of said oil duct from said oil branch duct during movement of said ring rail toward a highest position, and a metering means in said oil branch duct for metering oil therethrough.

10. The combination as set forth in claim 9 which further includes a sealing means in said oil duct for sealingly engaging about said oil branch duct upon insertion of said oil branch duct into said oil duct.

11. The combination of an oil duct on a movably mounted ring rail; an oil branch duct below and adjacent said oil duct, said oil branch duct having an outlet for oil disposed for insertion into said oil duct upon downward movement of said ring rail to an underwinding position and removal from said oil duct upon upward movement of said ring rail into a bobbin winding position; and a metering means for metering oil through said oil branch duct into said oil duct when said ring rail is in said underwinding position.

* * * * *